US005935686A

United States Patent [19]

Daelmans et al.

[11] Patent Number: 5,935,686

[45] Date of Patent: Aug. 10, 1999

[54] PACKAGING WRAPPER CLOSED BY TWISTS, AND PACKAGING PROCESS

[75] Inventors: Eddy Daelmans, Dilsen-Stokkem; Raymond Vanoppre, Diest, both of Belgium

[73] Assignee: Transpac N.V, Brussels, Belgium

[21] Appl. No.: 08/973,013

[22] PCT Filed: Oct. 8, 1996

[86] PCT No.: PCT/EP96/04378

§ 371 Date: Nov. 26, 1997

§ 102(e) Date: Nov. 26, 1997

[87] PCT Pub. No.: WO97/24273

PCT Pub. Date: Jul. 10, 1997

[30] Foreign Application Priority Data

Dec. 29, 1995 [BE] Belgium ..... 9501085

[51] Int. Cl.[6] ..... B32B 9/00

[52] U.S. Cl. ..... 428/194; 428/35.7; 428/192; 428/195; 428/196; 428/197; 428/202; 428/346; 428/349; 229/87.01; 206/524.1; 53/390; 47/72

[58] Field of Search ..... 428/346, 409, 428/349, 35.7, 194, 192, 195, 196, 197, 202; 53/390, 397, 461; 206/524.1; 47/72; 229/87.01, 87.19, 800

[56] References Cited

U.S. PATENT DOCUMENTS 4,663,219 5/1987 Janocha et al. ..... 428/213

FOREIGN PATENT DOCUMENTS 91 11 671 U 1/1992 Germany ..... B65D 65/40
1096058 12/1967 United Kingdom ..... B65D 65/14

*Primary Examiner*—William Krynski
*Assistant Examiner*—Abraham Bahta
*Attorney, Agent, or Firm*—Leydig, Voit & Mayer, Ltd.

[57] ABSTRACT

The packaging wrapper consists of a film intended to be closed by at least one twist (22), including, on the internal side, a cold-sealing coating placed along two lengthwise strips (12, 14) on either side of the article to be packaged in order to retain the twists. The film additionally has at least one transverse additional strip (24), (26) of cold-sealing coating placed along one edge of the film (20) perpendicularly to the lengthwise strips (12, 14). The packaging process consists in closing the wrapper by virtue of the transverse strips (24), (26), along a direction parallel to the axis passing through the twists (22).

6 Claims, 8 Drawing Sheets

PACKAGING WRAPPER CLOSED BY TWISTS, AND PACKAGING PROCESS

The present invention relates to a packaging wrapper for articles, the said wrapper being closed by means of at least one twist.

The invention also relates to the production of a packaging closed by twists.

In particular, the invention relates to the field of the packaging of confectionery products

DESCRIPTION OF RELATED ART

Confectionery products are generally packaged individually in a portion of preprinted film of appropriate size and shape, it being possible for these individually packaged products to be in their turn packed in bulk in a small packaging bag of an appropriate size. Typically, the article to be packaged is first of all completely wrapped in a rectangular piece of film and the wrapper thus formed is closed by twists at two points situated on either side of the article to be packaged.

It will be noted that these packages are not always closed by two twists. It is possible, for example, to deposit the article to be packaged in the centre of a suitable piece of film, the sections of which extending beyond the article are folded on top of the said article before the wrapper thus formed is closed by twining the said sections into a single twists.

In the context of the present invention a twist is intended to mean the result of the closure of the said wrapper by twining.

An important problem which arises where this is concerned is that of the retention of the twist. This retention can be obtained only at the cost of a particular choice of the film employed as substrate, which must exhibit appropriate mechanical characteristics, such as pliability or, in particular, a pronounced tendency not to return to its initial position after the twining of the said film.

In particular, this problem becomes apparent during the packaging of articles of small sizes and of substantially round section, such as confectionery products like, for example, bonbons, lollipops, barley sugar, fruit jellies, chocolate-coated bars or more bulky products like bottles, rolls of articles etc.

As solution, it is known to select particular substrates known for their high pliability, like waxed paper or cellophane, or else synthetic films containing an appropriate quantity of an additive increasing the pliability of the said substrate.

This solution is obviously not satisfactory insofar as it considerably restricts the possibilities of choice of films employed as packaging substrate and insofar as it considerably increases the cost.

Packages closed by twists, which are produced from substrates precoated with a heat-sealing coating, are known on the market. When twists are formed at the ends of the wrapper containing the article to be packaged, a source of heat at a temperature of approximately between 120 and 160° C. is approached for a certain period of time—in general it is the jaws performing the twining that are heated, but it is also possible to blow hot air by means of a pipe of appropriate size—over the said twists, and this has the result of melting the heat-sealing coating and the sealing of the twist thus formed when the said heat-sealing coating is cooled.

This solution enables the choice of the packaging substrate to be widened, but is nevertheless still not entirely satisfactory, insofar as it does not permit the selection of a substrate which has a low strength at elevated temperatures and, what is more serious, it is completely unsuitable for the packaging of heat-sensitive articles, in particular the products of chocolate manufactures. Another defect of this solution is the relatively low speed which it imposes; it is necessary, in fact, to keep the twists and the heating element in contact for a sufficient time to produce the melting of the sealing coating.

It is generally considered that the packaging of 800 articles per minute is the highest rate that it is possible to obtain with a packaging unit operating on the principle of closure of the wrapper by twining and heat-sealing of the twist thus formed.

To overcome the disadvantages of heat-sealing and without being restricted in the choice of the films employed, document GB-A-1096058 proposes a film with a cold-sealing coating which, after the wrapper has been closed by twining the twists, exhibits excellent retention. This cold-sealing coating is in the form of two lengthwise strips situated in the regions of formation of the twists on either side of the article to be packaged.

Cold-sealing is intended to mean a sealing which is performed instantaneously merely by contact at a temperature of approximately between 0 and 50° C. In reality the temperature is not a critical parameter for obtaining sealing by means of a cold-sealing coating and has practically no effect on the quality of the sealing obtained. The sealing is therefore performed without any additional heat input at the ambient temperature of the space in which the packaging unit is situated being necessary.

In fact, until now, cold-sealing coatings have been employed above all as a layer on a substrate subjected to little or no deformation. Considerable blocking problems can be expected, due to the self-adhesive properties of the cold-sealing coating in any use of this cold-sealing coating on a nonplanar substrate.

The method described in the abovementioned document uses this characteristic to advantage in order to obtain the retention of the twist.

In addition, in the case of a twist retained by means of a cold-sealing coating, it is not necessary to apply a pressure over the whole length of the twist. Nevertheless, this results in a sealing which is uniform over the whole length of the twist by virtue of the action of the torsional forces imparted during the twining of the wrapper.

This method therefore makes it possible to employ films which are less expensive and which exhibit better properties (rigidity, printability, aesthetic qualities) for the packaging of articles without any restrictions as to the shape or the heat-sensitivity of the said articles.

As for the rates which it is possible to reach with a packaging unit operating on the principle of closure of the packaging by twining and cold sealing of the twist thus formed, it is appropriate to note that the only limit on the rate is imposed by the machine itself. This packaging method therefore makes it possible to reach rates of at least 1500 articles per minute.

SUMMARY OF THE INVENTION

The aim of the present invention is to provide a new packaging of the cold sealing of the twist type, which exhibits all the known advantages of this type of packaging but which, in addition, allows a virtually hermetic closure of the packaging. Another aim of the invention is to provide a new method of packaging which is suited especially to this type of packaging.

In accordance with the invention this aim is attained by a packaging wrapper consisting of a film and intended to be closed by at least one twist including, on the internal side in relation to the article to be packaged, a cold-sealing coating placed along two parallel lengthwise strips on either side of the article to be packaged, characterized in that the film has at least one transverse additional strip of cold-sealing coating placed along one edge of the film perpendicularly to the said lengthwise strips of sealing coating so as to allow, after the twining of the wrapper, the latter to be closed along a direction parallel to the axis passing through the two twists.

Thus, the package is closed virtually hermetically, which is very advantageous with regard to the conservation of the articles, since it prevents the entry of moisture, of gas, of air or other substances and, at the same time, conserves the flavours within.

According to an advantageous embodiment, the film has two transverse strips of cold-sealing coating extending perpendicularly between the lengthwise strips along the opposite edges. In this way, when the article is placed on the film with a view to the packaging, it is completely surrounded by strips of cold sealing.

The invention also provides a new process for packaging an article in a film including two lengthwise strips of cold-sealing coating and at least one transverse strip of cold-sealing coating extending along one edge perpendicularly between the lengthwise strips, according to which the article is deposited on the film on the side of the said strips, the two sections which are perpendicular to the lengthwise strips are raised substantially vertically, the two sections are brought close on top of the article and their edges are sealed by pressure, to one another, the two edges thus sealed are folded back over the article and the projections of the film extending beyond and on either side of the article are twined to form two twists at the lengthwise strips.

This method, which allows pressure to be used, makes possible a perfect closure over the whole length of the film between the twists. Given that the sealing coating also allows a good closure at the twists, the package will be perfectly leakproof on all sides.

When the film has two lengthwise strips and two transverse strips, it is also possible to produce a leakproof package with a single twist. It suffices to place the article in the middle of the four strips, to raise the four sections of the film and to twine them on top of the article to form the twist.

When a reel of packaging film, one of the faces of which is coated with a sealing coating, is prepared, an at least partial release coating of the film employed is preferably applied to the other face in order to prevent the adhesiveness due to contact between the face coated with the sealing coating and the other face during the reeling. It is appropriate, however, to note that there are so-called "dry" cold-sealing coatings which, when employed in conjunction with certain substrates such as polypropylene films, do not require such a release coating Both these methods can also be employed within the scope of the present invention.

Any release coatings that are conventionally applied to the back of the face of the film which carries the strips of cold-sealing coating can be employed within the scope of the present invention. In particular, release coatings that are suitable consist of mixtures of polyamide resins and of polyethylene waxes (for example the products 10-609345-3p of the company Siegwerk and 994404-x of the company SICPA) In general, these release coatings are deposited onto the substrate at a rate of 1 to 5 g/m$^2$.

According to a particularly advantageous embodiment, the piece of film coated with cold-sealing coating and intended to form the packaging wrapper has regions coated with cold-sealing coating from 1 to 50 mm in width which are situated around the space reserved for the article to be packaged. By doing this, any problem of contamination between the packaged article and the cold-sealing coating is avoided, if need be, and, in addition, a substantial saving of the said sealing coating is produced. On the other hand, the property of retention of the twists is completely retained, since the regions coated with cold-sealing coating have been appropriately arranged at the place of the film where the said twists are formed.

The cold-sealing coating is therefore preferably arranged according to an appropriate pattern which is adapted to the article to be packaged.

The said regions coated with cold-sealing coating can take the form of parallel strips (for example for a bonbon or a lollipop whose packaging has two twists) or the form of noncontinuous regions (triangles, quadrilaterals) depending on the form of the article to be packaged or the presentation of the said article (for example lollipop or barley sugar, the packaging of which has a single twist).

As indicated above, one of the advantages of the cold-sealing coating is that it makes it possible to employ a wide range of possibilities where the nature of the substrate employed is concerned. Examples of appropriate substrates are plastic films of approximately 10 to 100 microns made of extruded and oriented polypropylene, of polypropylene in the form of cast film, of polyester, of polyethylene, of extruded and oriented polyamide or of polyamide in the form of cast film.

In accordance with the present invention it is also possible to employ a paper substrate (machine-glazed or coated) In general, any flexible-support material or packaging material can be suitable as substrate according to the present invention. These various substrates may consist of a single layer, a metallized single layer, or of a number of laminated and/or coextruded layers.

The choice of the cold-sealing coating is not of a critical nature. As cold-sealing coating it is possible to envisage pressure-sensitive adhesives, which are substances that are permanently adhesive and which adhere spontaneously to the surface of most materials under the effect of a single moderate pressure.

As a general rule, the pressure-sensitive adhesives are compositions based on natural and/or synthetic rubbers used in combination with modified cellophanes, phenol-formaldehyde resins or hydrocarbon resins (waxes). Besides the rubbers, polymers based on styrene, (meth)acrylic acid or vinyl ether are widely employed, alone or mixed, also in combination with resins. Lastly, silicone resins can also be employed. Compositions including mixtures of natural and synthetic rubbers and copolymers of (meth)acrylic acid and styrene are preferably employed.

In accordance with the present invention the cold-sealing coatings are deposited onto the substrate in a proportion of approximately from 1 to 5 g/m$^2$.

The cold-sealing coatings may be applied in the form of solution or dispersion or even in the molten state.

It is also possible to deposit another coating, for example an inert or release coating, between and/or on either side of the strips of cold-sealing coating. Any coating which is compatible with the nature of the product to be packaged may be employed as other coating. In general, these other coatings are also deposited onto the substrate in a proportion of approximately from 1 to 5 g/m$^2$.

The films in accordance with the present invention are prepared by coating deposition techniques which are well known to a person skilled in the art, such as, for example, heliographic or flexographic printing or offset printing.

BRIEF DESCRIPTION OF THE DRAWINGS

The invention will be understood better on reading the description of a few embodiments which are presented below, by way of illustration, with reference to the appended drawings, in which:

FIGS. 8*a*, 8*b* and 8*c* represent views in perspective of the various sequences.of packaging of the article with the film according to the present invention;

DESCRIPTION OF THE PREFERRED EMBODIMENTS

Figure 1:
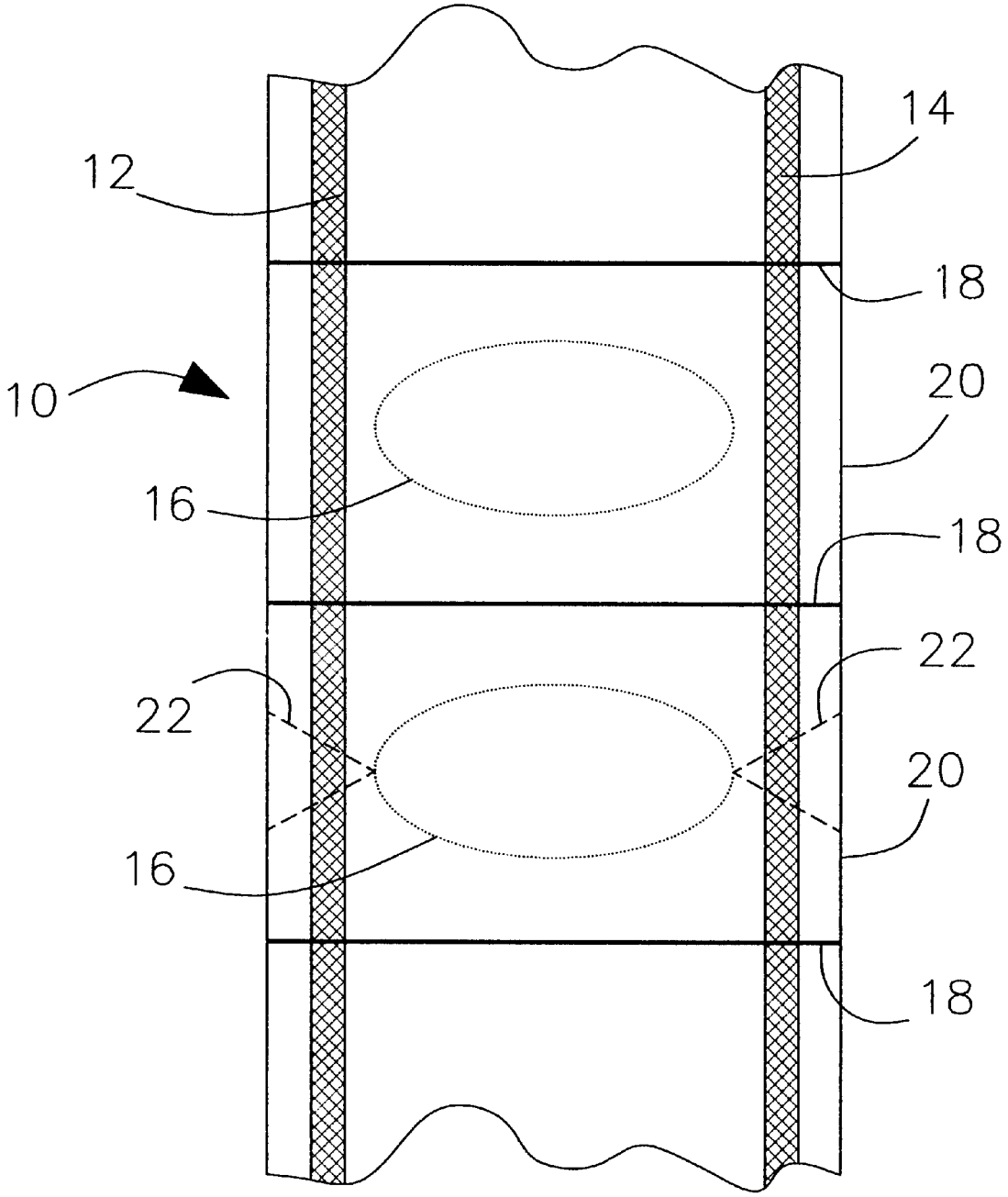
FIG. 1 shows a known package of the kind described in document GB-A-1096058.

FIG. 1 shows a film strip indicated overall by reference 10, which is coated with two lengthwise strips 12, 14 of a cold-sealing coating. The articles to be packaged are shown in dotted lines by reference 16. The film strip is intended to be cut along the lines 18 in order to provide pieces of film 20 which are identical with each other and which act as the packaging wrapper for the articles 16. Also shown by dotted lines in FIG. 1 is the outline of twists 22 which are obtained by twining the projections on either side of the article to be packaged 16.

Figure 2A:
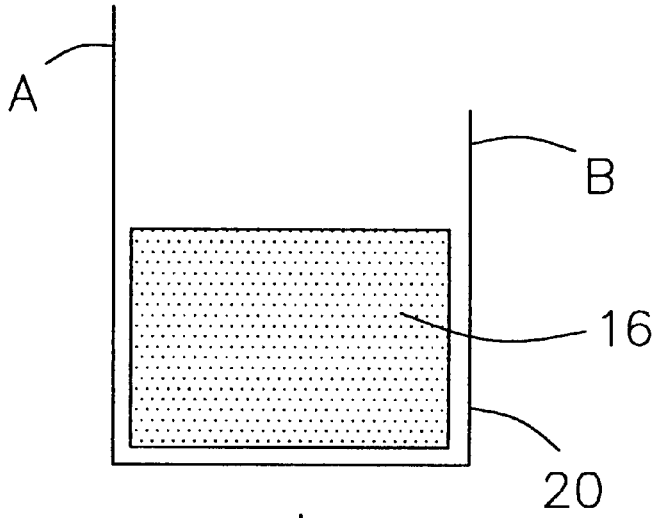
FIGS. 2*a*, 2*b* and 2*c* show, in cross-section, the successive stages of the packaging of the article with the aid of a film according to FIG. 1.
Figure 2B:
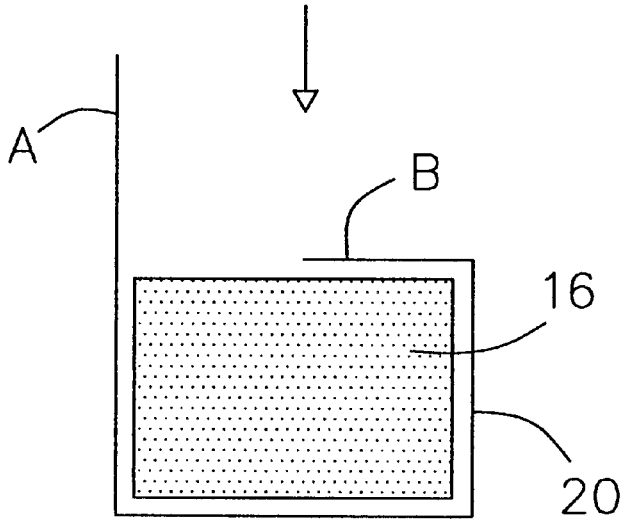
Figure 2C:
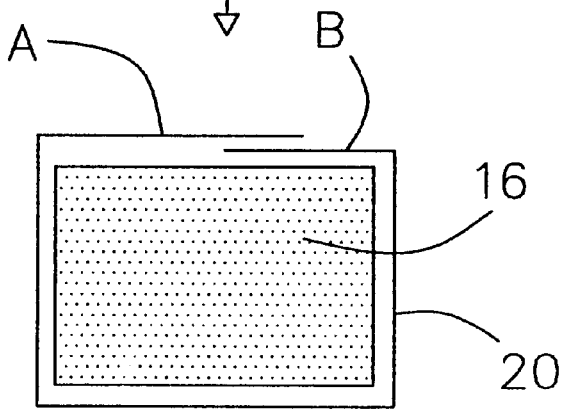
Figure 3A:
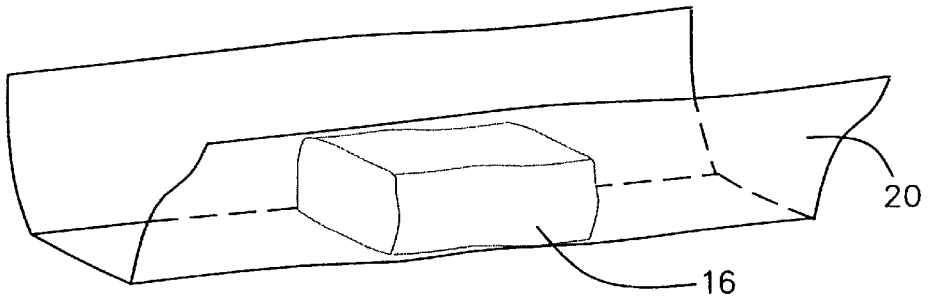
FIGS. 3*a*, 3*b* and 3*c* are views in perspective of the stages of packaging shown in FIGS. 2.
Figure 3B:
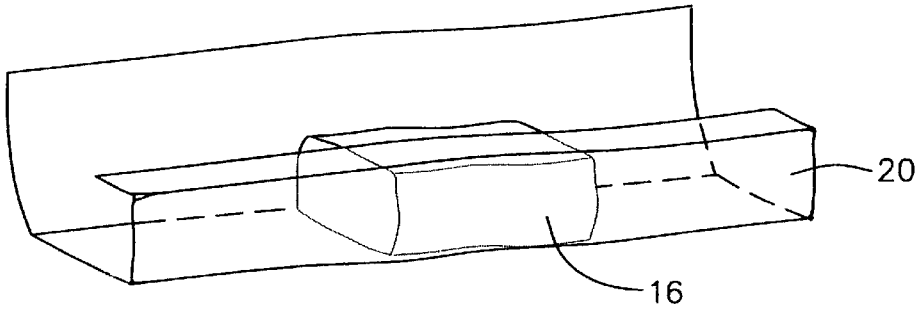
Figure 3C:
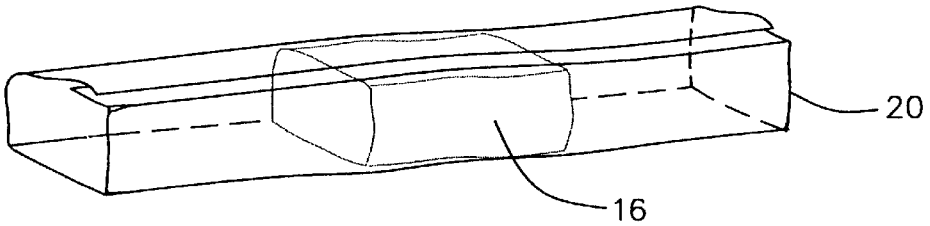

FIGS. 2 and 3 show the various sequences of a conventional packaging process, FIGS. 2 being sections along a plane perpendicular to the axis passing through the future twists.

Figure 4:
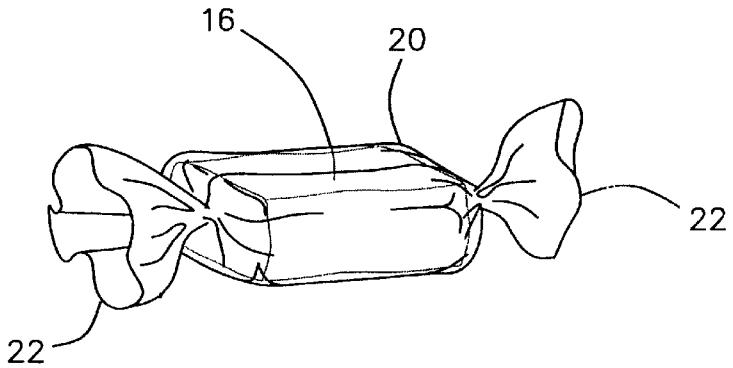
FIG. 4 is a view of the article packaged with two twists.

The article to be packaged 16 is placed on a thin film 20 and the two sections with the cut edges 18 of FIG. 1 are raised vertically against the article 16. It should be noted that, in the example shown, the article 16 is off-centre on the thin film 20 so that one of the sections, in this case that shown by A, is longer than the section B, as FIG. 2*a* shows. The shortest section B is next folded back over the article 16 (see FIGS. 2*b* and 3*b*) and next the section A is folded back over the article 16 and the edge of the section B (see FIG. 2*c*) to form the structure of FIG. 3*c*. The two ends extending beyond the article 16 are next twined by turning each in the direction of the folding-back of the section A to form the two twists 22 shown in FIG. 4.

Figure 5:
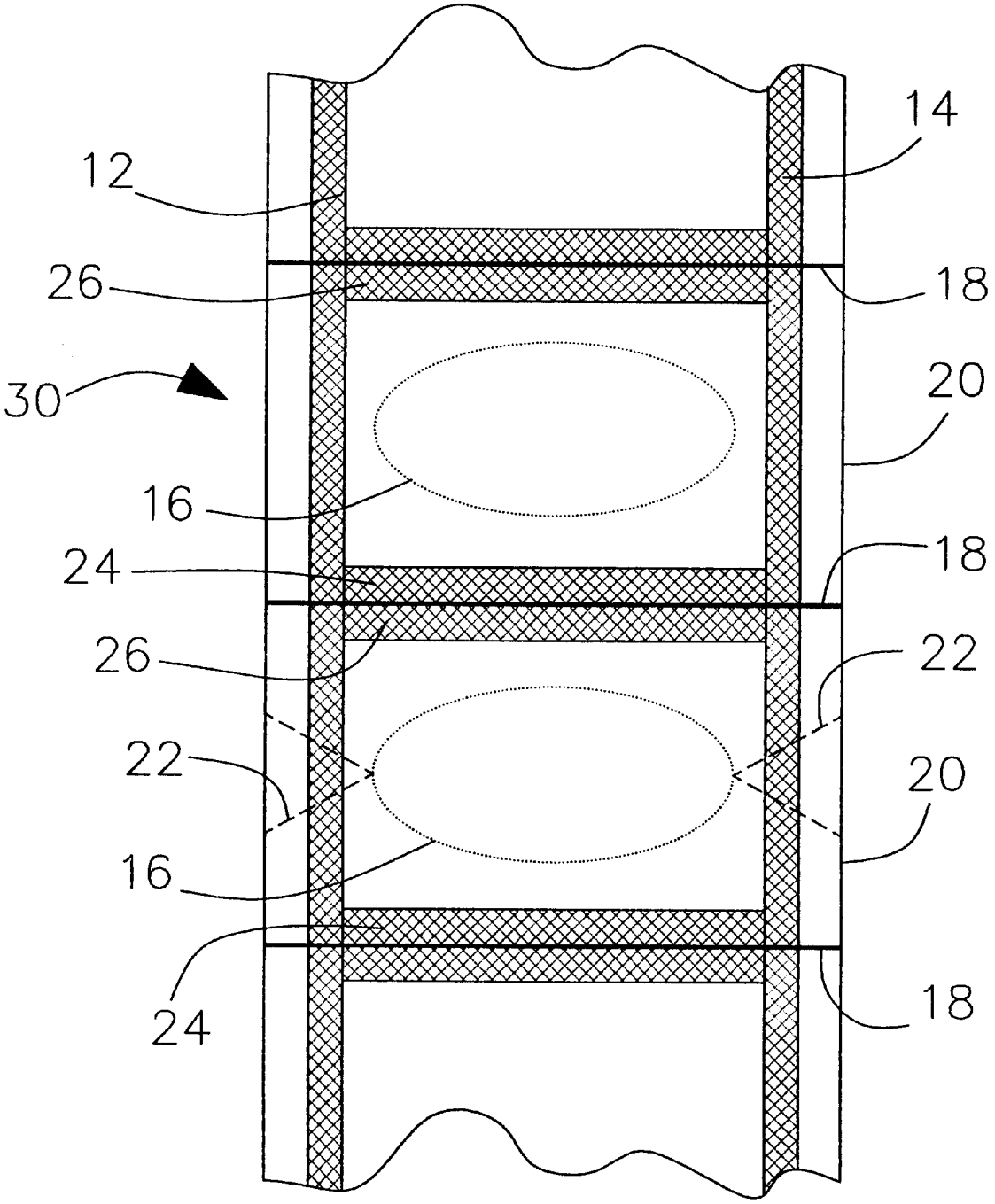
FIG. 5 is a plan view of a packaging film according to the present invention.

FIG. 5 shows a packaging film 30 according to the present invention. In this figure the same reference numbers have been employed to denote the parts corresponding to those of FIG. 1. As can be seen, the film 30 also comprises two lengthwise strips 12 and 14 of cold-sealing coating. In accordance with the invention the film additionally comprises transverse strips 24 and 26 extending along the cut edges perpendicularly between the lengthwise strips 12 and 14 on either side of the spaces reserved for the articles to be packaged 16.

Figure 6:
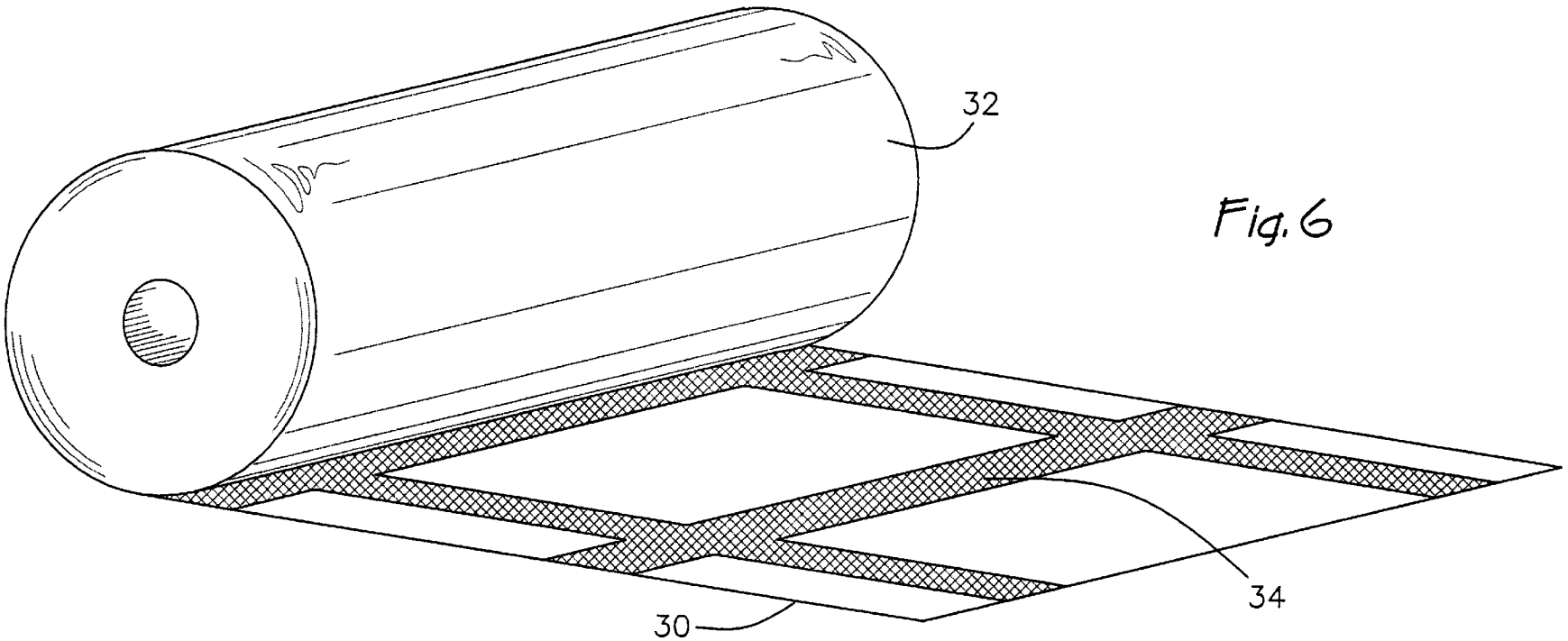
FIG. 6 shows a view in perspective of a reel of a packaging film.
Figures 7A, 7B, 7C, 7D:
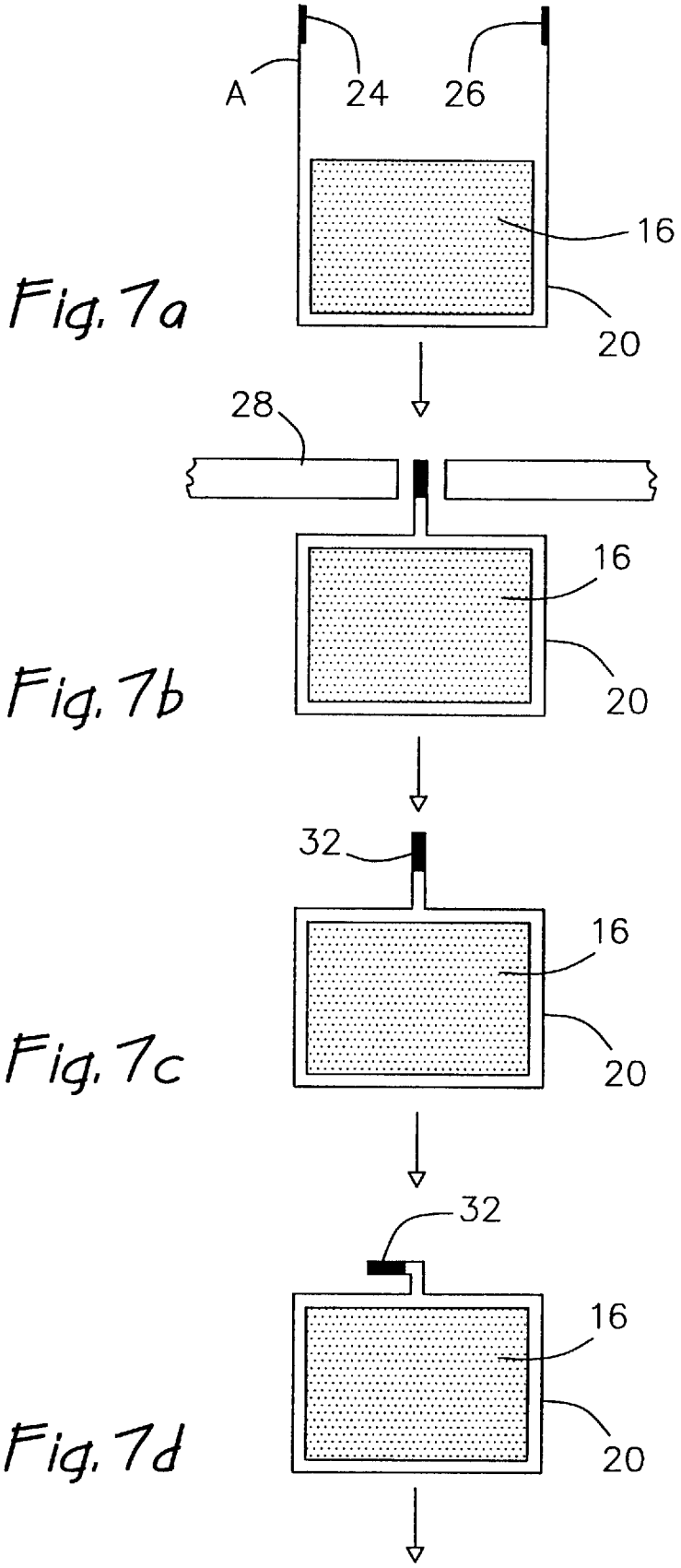
FIGS. 7*a*, 7*b*, 7*c* and 7*d* are the successive sequences of packaging of the article with the aid of a film according to the present invention.
Figure 8A:
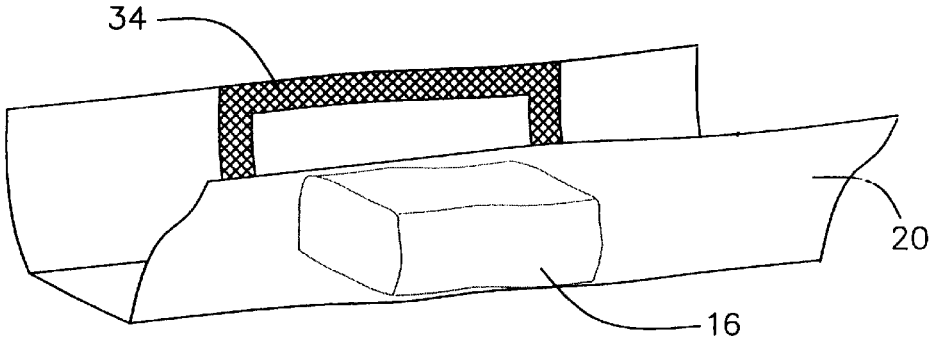
Figure 8B:
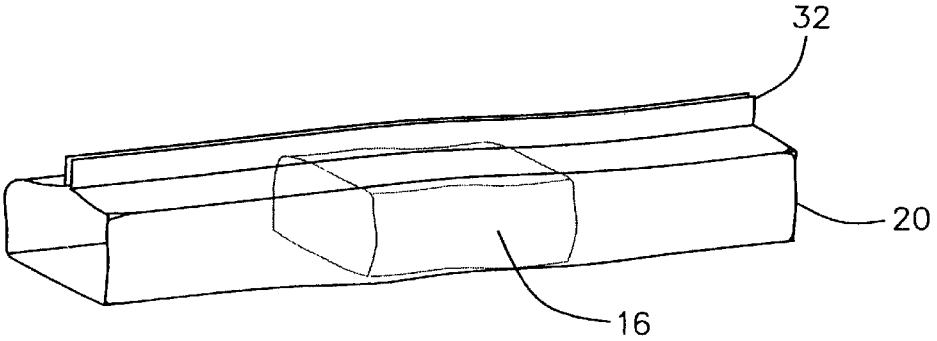
Figure 8B:
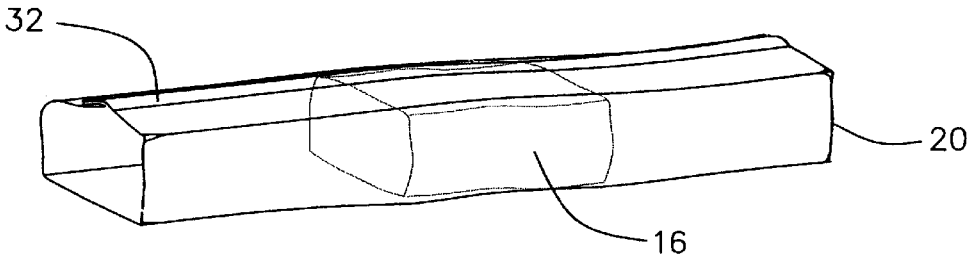
Figure 9:
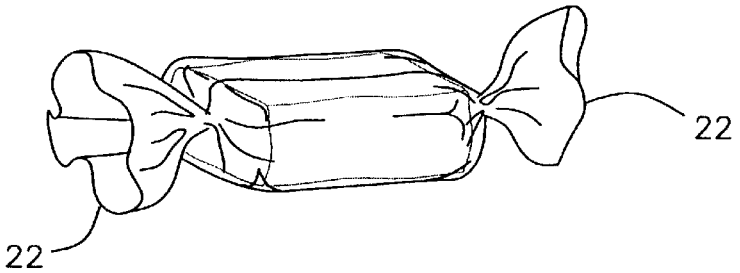
FIG. 9 shows the packaged article after the formation of the two twists.

During use, the film 30 is dispensed from a reel as shown in FIG. 6, the cold-sealing coating structure 34 being on the interior side. The film 30 is next sectioned along the cut lines 18 passing through the middle of the transverse strips to form individual thin films 20.

Figure 10:
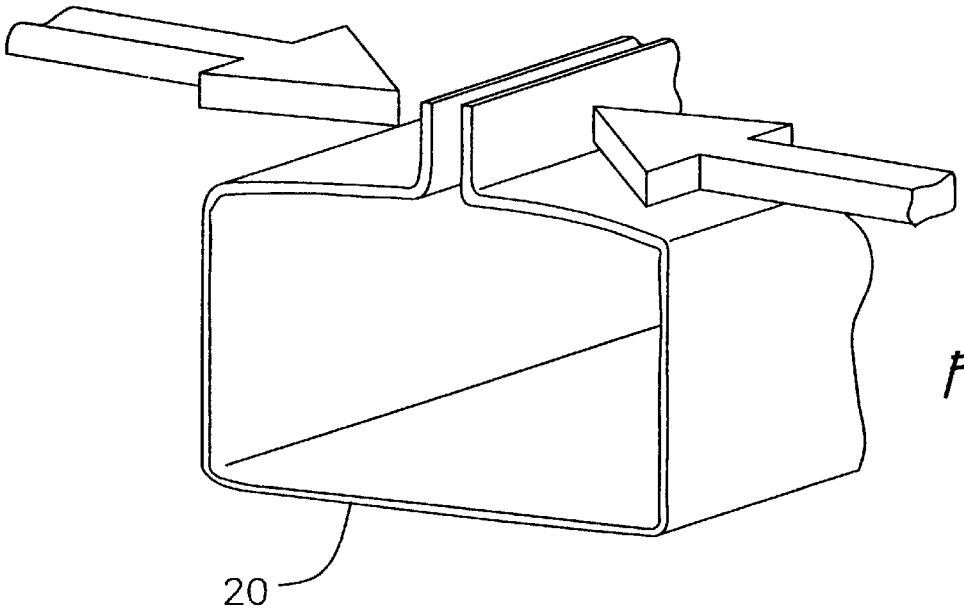
FIGS. 10 and 11 show the sealing and the folding of the packaging according to the present invention in the direction parallel to the axis passing through the twists.
Figure 11:
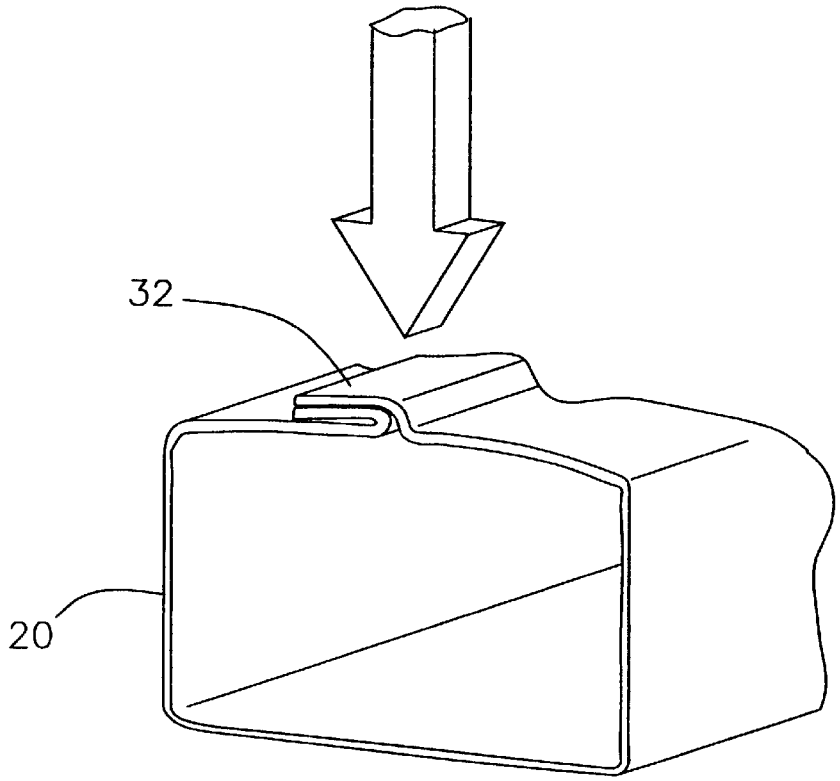

The film 30 is particularly well suited to an advantageous packaging process proposed by the present invention and explained in greater detail in what follows with reference to FIGS. 7 to 11. The article 16 is placed on a thin film 20 within the frame of cold-sealing coating and the two side sections are folded upwards, as shown in FIGS. 7*a* and 8*a*. However, in contrast to the known process, the article 16 is this time placed in the centre of the thin film, such that the two sections A and B should be of perfectly the same length. The two sections are next folded back simultaneously over the article 16 so that their internal edges with the transverse strips 24 and 26 are placed one against the other, as shown in FIG. 7*b*. As shown in FIG. 10, a pressure is next applied to the exterior of each of the edges of the sections A and B over the whole width, in order to seal together these two sections well at their cold-sealing coating. This operation of folding of the sections A and B and of sealing of their edges may be performed in a single operation between the jaws of a press 28 (FIG. 7*b*) A sealing rib 32 is thus obtained, which extends over the whole width as shown as FIGS. 7*c* and 8*b*. This rib is next folded and folded back over the package according to FIGS. 7*d* and 8*c*, preferably, by applying a vertical pressure according to FIG. 11 to give the package an attractive appearance. The package is finished by twining the two ends in the direction of the folding-back of the rib 32 to form two twists.

By virtue of the presence of the transverse strips 24, 26 of cold-sealing coating and by virtue of the use of pressure, a perfect closure is obtained over the whole width of the packaging. The lengthwise strips 12 and 14 additionally ensure a side sealing when the twists are formed. A virtually hermetic packaging is thus produced, which prevents the exit of the flavours or the entry of air, of moisture, of detrimental odours and the like.

The examples which follow illustrate the invention further without limiting it.

Example 1: A release coating (10-609345-3p from the company Siegwerk) is deposited at a rate of 1.5 g/m$^2$ onto a white oriented polypropylene film of 30 micron thickness. On the other face of the same film are deposited lengthwise strips, 15 mm wide, of cold-sealing coating (product 22-392 from the company Croda), at a rate of 3 g/m$^2$, 40 mm apart and, perpendicularly to the lengthwise strips, between these strips, are deposited parallel strips, 15 mm wide, of cold-sealing coating (product 22-392 from the company Croda), at a rate of 3 g/m$^2$, 80 mm apart, with a length of 40 mm.

Example 2: Use of the film for the manufacture of packages closed by twists.

With the films of Example 1 products of chocolate manufacture (of various sizes, weights and shapes) are packaged with a packaging-twining machine from the company Pactec. The machine is set at a rate of 1200 products per minute.

Articles packaged in a wrapper closed by twists are thus obtained with an impeccable appearance and an excellent retention of the twist. The packages formed with the film of Example 1 have the special feature of being completely hermetic and leakproof.

We claim:

1. A wrapper for packaging an article, the wrapper comprising a film of material adapted to be closed by at least one twist, a top side of the film disposed toward the article having two parallel lengthwise strips of cold-seal coating, a lengthwise strip disposed on each side of the article, the top side further having a transverse strip of cold-seal coating disposed along a first edge of the film and perpendicular to the lengthwise strips to allow the wrapper, after twisting to be sealed along a direction parallel to the axis passing through the twist.

2. The wrapper of claim 1 further comprising a second transverse strip of cold-seal coating extending perpendicularly between the lengthwise strips along a second edge of the film opposite the first edge.

3. The wrapper of claim 1, in which a bottom side of the film is coated with a release coating.

4. A method for packaging an article in a film, the film comprising a top side having two lengthwise strips of cold-seal coating and at least one transverse strip of cold-seal coating extending along a first edge of the film and perpendicular to the lengthwise strips, the method comprising the steps of:

depositing the article on the top side of the film between the lengthwise strips, vertically raising two sections of the film which are perpendicular to the lengthwise strips, folding the two sections over the article so that ends of the sections mate, sealing the mated ends to one another by pressure, folding the mated ends back over the article, and twisting projections of the film extending beyond and on either side of the article to form two twists at the lengthwise strips.

5. The method of claim 4, in which the first folding and sealing steps are carried out as a single operation between opposing jaws of a press.

6. The wrapper of claim 2, in which a bottom side of the film is coated with a release coating.

* * * * *